US010828519B2

(12) United States Patent
Kim et al.

(10) Patent No.: US 10,828,519 B2
(45) Date of Patent: Nov. 10, 2020

(54) AUTOMATIC FIRE EXTINGUISHER PROVIDING USER CONVENIENCE

(71) Applicant: Jin Tai Kim, Seoul (KR)

(72) Inventors: Jin Tai Kim, Seoul (KR); Seung Yun Kim, Seoul (KR); Song Yi Kim, Seoul (KR)

(73) Assignee: Jin Tai Kim, Seoul (KR)

( * ) Notice: Subject to any disclaimer, the term of this patent is extended or adjusted under 35 U.S.C. 154(b) by 148 days.

(21) Appl. No.: 15/756,338

(22) PCT Filed: Sep. 1, 2016

(86) PCT No.: PCT/KR2016/009800
§ 371 (c)(1),
(2) Date: Feb. 28, 2018

(87) PCT Pub. No.: WO2017/039357
PCT Pub. Date: Mar. 9, 2017

(65) Prior Publication Data

US 2018/0311520 A1 Nov. 1, 2018

(30) Foreign Application Priority Data

Sep. 2, 2015 (KR) ..... 10-2015-0123915
Aug. 22, 2016 (KR) ..... 10-2016-0105862

(51) Int. Cl.
*A62C 13/76* (2006.01)
*A62C 13/00* (2006.01)
*A62C 13/64* (2006.01)

(52) U.S. Cl.
CPC ..... *A62C 13/76* (2013.01); *A62C 13/00* (2013.01); *A62C 13/64* (2013.01)

(58) Field of Classification Search
CPC ..... A62C 13/76; A62C 13/78; A62C 13/64; A62C 13/14; A62C 35/10; A62C 13/00;
(Continued)

(56) References Cited

U.S. PATENT DOCUMENTS 4,256,181 A * 3/1981 Searcy ..... A62C 37/12 169/65
5,052,494 A * 10/1991 Larsen ..... A62C 3/04 169/26

FOREIGN PATENT DOCUMENTS

KR 20-0117154 Y1 7/1998
KR 20-0391789 Y1 8/2005
(Continued)

OTHER PUBLICATIONS

International Search Report for PCT/KR2016/009800 dated Dec. 15, 2016, citing the above references.

*Primary Examiner* — Tuongminh N Pham
(74) *Attorney, Agent, or Firm* — Hauptman Ham, LLP

(57) ABSTRACT

Provided is an automatic fire extinguisher providing a simplified operation method for easily pulling out a safety pin while a handle is strongly grasped and allowing a spray hose to automatically aim a flame, and, furthermore, which is easily recognizable even from a distance when the safety pin is separated at normal times. The automatic fire extinguisher includes a main body vessel (55) in which a fire extinguishing agent is filled, a lower handle (2) coupled to a plug (4) disposed on an upper portion of the main body vessel (55), and an upper handle (1) coupled to the lower handle (2) through a first hinge shaft (19).

12 Claims, 16 Drawing Sheets

(58) Field of Classification Search
CPC ..... A62C 37/02; A62C 37/00; A62C 37/10;
F16B 13/0808
See application file for complete search history.

(56) References Cited

FOREIGN PATENT DOCUMENTS

| | | | |
|---|---|---|---|
| KR | 10-0745840 | B1 | 8/2007 |
| KR | 10-1444688 | B1 | 9/2014 |
| KR | 10-1533302 | B1 | 7/2015 |

* cited by examiner

AUTOMATIC FIRE EXTINGUISHER PROVIDING USER CONVENIENCE

CROSS REFERENCE TO RELATED APPLICATION

This present application is a national stage filing under 35 U.S.C. § 371 of PCT application number PCT/KR2016/009800 filed on Sep. 1, 2016 which is based upon and claims the benefit of priority to Korean Patent Application Nos. 10-2015-0123915 and 10-2016-0105862 filed on Sep. 2, 2015 and Aug. 22, 2016, respectively, in the Korean Intellectual Property Office. The disclosures of the above-listed applications are hereby incorporated by reference herein in their entirety.

TECHNICAL FIELD

The present invention relates to an automatic fire extinguisher, and more particularly, to an automatic fire extinguisher providing user convenience so that a user frightened by fire may easily use the same.

BACKGROUND ART

Typical fire extinguishers that are widely known and distributed have many limitations due to a safety pin.

Firstly, the safety pin is not easily pulled out when fire actually occurs. When fire occurs, initial fire extinguishment using the fire extinguisher before fire trucks are arrived is extremely important. However, since people who discover the fire is generally in a frightened state and have no experience on using the fire extinguisher, people's typical behavior pattern shows that the people try to pull the safety pin while holding the fire extinguisher by hands. In consideration of characteristics of the typical fire extinguishers, when a handle of the fire extinguisher is grasped, especially when a frightened person grasps the handle with a strong grasping force unconsciously, the safety pin is not easily pulled out. Accordingly, golden time for initial fire extinguishment is frequently lost.

Secondly, in case of the typical fire extinguisher, since most spray hose is fixed to an accommodation hook attached to a main body vessel, it is difficult for the user frightened by fire to intuitively separate and use the spray hose. When a method for using the typical fire extinguisher is reviewed, a process of (1) removing the safety pin, (2) separating the spray hose fixed to the accommodation hook and aiming the spray hose to a flame, and (3) strongly grasping an upper handle and a lower handle is necessarily performed. However, when fire actually occurs, it is difficult to remember such a sequence, and even separating the spray hose fixed to the accommodation hook is difficult.

Thirdly, since the safety pin of the fire extinguisher tends to be easily separated at normal times, there is a possibility of malfunction. Furthermore, since the safety pin is horizontally inserted in case of the typical fire extinguisher, although the safety pin is lost, people may not notice such a state, and thus maintenance is difficult.

DISCLOSURE OF THE INVENTION

Technical Problem

The present invention provides an automatic fire extinguisher providing a simplified operation method for easily pulling out a safety pin while a handle is strongly grasped and allowing a spray hose to automatically aim a flame, and, furthermore, which is easily recognizable even from a distance when the safety pin is separated at normal times.

The objects of the present invention are not limited to the aforementioned object, but other objects not described herein will be clearly understood by those skilled in the art from descriptions below.

Technical Solution

An embodiment of the present invention provides an automatic fire extinguisher including: a main body vessel 55 in which a fire extinguishing agent is filled; a lower handle 2 coupled to a plug 4 disposed on an upper portion of the main body vessel 55; and an upper handle 1 coupled to the lower handle 2 through a first hinge shaft 19. Here, a handle support device disposed between the lower handle and the upper handle includes: an upper support for supporting the upper handle; a lower support for supporting the lower handle and surface-contacting the upper support through a contact surface; a coupling part disposed on one end of the contact surface to couple the upper support and the lower support to each other; and a safety pin for moving the upper support to release the surface-contact between the upper support and the lower support, an elastic member is disposed between the upper handle and the handle support device or between the lower handle and the handle support device, and a side surface of the upper support (hereinafter, referred to as an 'upper vertical surface') and a side surface of the lower support (hereinafter, referred to as a 'lower vertical surface'), which are connected to the coupling part, are disposed on the same plane.

In an embodiment, each of the upper vertical surface and the lower vertical surface may be perpendicular to the contact surface.

In an embodiment, the automatic fire extinguisher may further include a guide device coupled to the lower handle or the plug through a second hinge shaft.

In an embodiment, the upper handle may include a protruding part disposed opposite to a grip area with respect to the first hinge shaft, and contact end parts between the protruding part and the guide device may be linearly disposed on a front view in a state in which surface-contact between the upper support and the lower support is maintained.

In an embodiment, both ends of each of the contact end parts may be disposed on a circumference having a center at the second hinge shaft.

In an embodiment, the automatic fire extinguisher may further include a rotary spring disposed around the second hinge shaft to apply a force lifting the guide device in a horizontal direction.

In an embodiment, the automatic fire extinguisher may further include a separating projection provided on the upper vertical surface or the lower vertical surface, which is adjacent to the coupling part.

In an embodiment, the safety pin may be connected to another side surface (hereinafter, referred to as an 'upper inclined surface') of the upper support, which is disposed opposite to the upper vertical surface, and, when a user pulls the safety pin, the surface-contact between the upper support and the lower support may be released.

In an embodiment, the upper support may include an upper support skirt extending downwards from another side surface opposite to the upper vertical surface, a slider connected to the safety pin and seated on the lower handle may include a skirt catching part moving the upper support skirt, and, when a user pulls the safety pin, the skirt catching part may move the upper support skirt, and thus the surface-contact between the upper support and the lower support may be released.

In an embodiment, the automatic fire extinguisher may further include a safety handle disposed below the lower handle, and the safety handle may have one end coupled to a grip area of the lower handle, and a protruding stopper inserted into a stopper hole defined in the lower handle may be provided on the other end of the safety handle.

In an embodiment, the stopper may include a recessed part defined in a lower sidewall thereof, and, when the safety handle is pulled, the other end of the safety handle may contact the lower handle, the stopper may be inserted into the stopper hole, and the slider may linearly move through the recessed part.

In an embodiment, the automatic fire extinguisher may further include a safety pin for distribution, which horizontally passes through the stopper to restrain a horizontal movement of the slider.

Particularities of other embodiments are included in the detailed description and drawings.

Advantageous Effects

As described above, the automatic fire extinguisher according to the present invention has excellent effects as follows.

First, although the user who is frightened by fire strongly grasps the handle of the fire extinguisher without pulling out the safety pin, the safety pin may be easily released with an even extremely small force. That is, according to the present invention, the handle support device supporting both handles does not react with respect to the strong grasping force applied to the both handles by the user. However, the safety device is easily released when the safety pin is pulled with the small force although the both handles are strongly grasped.

Second, since the spray hose automatically aims in the horizontal direction as soon as the safety device is released, the groping action for separating the typical spray hose fixed to the accommodation hook may be prevented.

Third, although the safety device is accidentally released at normal times, since the spray hose is automatically lifted, the state of the fire extinguisher may be recognized.

Fourth, when the safety handle is additionally installed on the handle of the fire extinguisher, since the safety pin is not released unless the user strongly grasps the safety handle, undesirable release of the safety pin from the fire extinguisher at normal times may be prevented.

Furthermore, since the coupling part of the handle support device that supports the both handles is separated when the both handles are strongly grasped to use the fire extinguisher, the single-use fire extinguisher may be manufactured. In this case, It may be fundamentally prevented that people without permission illegally refill the fire extinguishing agent into the fire extinguisher

MODE FOR CARRYING OUT THE INVENTION

Figure 1:
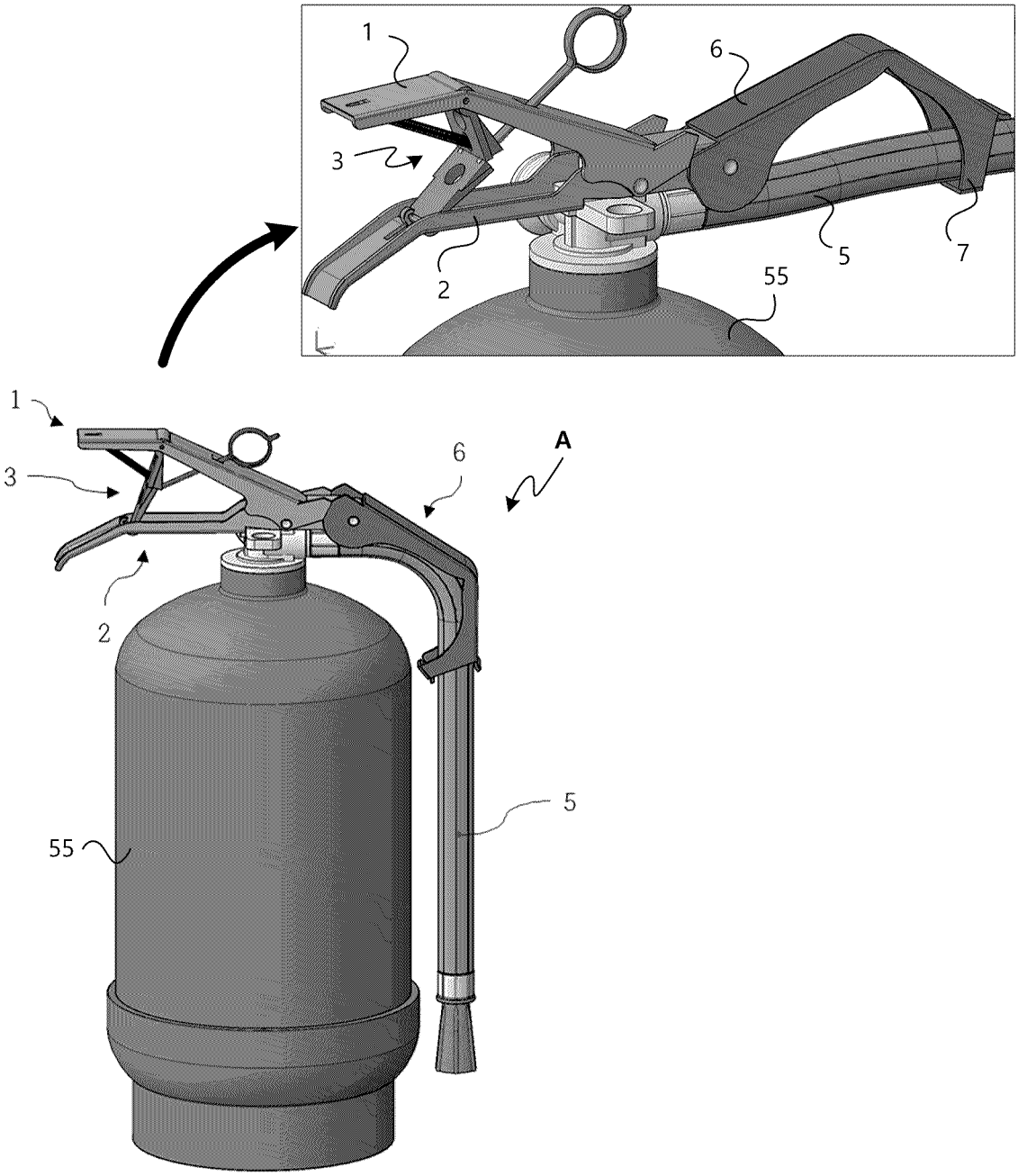
FIG. 1 is a perspective view and a partially enlarged perspective view illustrating an automatic fire extinguisher according to a first embodiment of the present invention.

Advantages and features of the present disclosure, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims. Like reference numerals refer to like elements throughout.

A handle support device according to the present invention may be applied to various fire extinguisher having upper and lower handles (or levers), e.g., a powder fire extinguisher, a halon fire extinguisher, and a carbon dioxide fire extinguisher. Accordingly, although the powder fire extinguisher is exemplarily described in embodiments of the present invention, the embodiments of the present invention are not limited thereto. For example, when the handle support device according to the present invention is applied to a fire extinguisher without a spray hose, a guide device may not be separately provided, and, depending on cases, the guide device having a simplified shape may be attached to the upper handle in the present invention.

Also, a safety pin according to the present invention, which is a tool for releasing a coupling of the handle support device, may be made of a flexible material instead of a hard material. Although a case in which a handle is provided on an end of the safety pin, so that a user pulls the safety pin by oneself is exemplarily described in the embodiments, the embodiments of the present invention are not limited thereto. For example, a temporary safety pin for releasing the coupling by applying a force to the handle support device may be used. For example, although the handle is not provided on the safety pin, the user may apply a force to the handle support device. Furthermore, although the user does not directly apply a force to the handle support device, a different type of safety pin may be used to release the coupling of the handle support device. For example, as a safety pin including a weight and a rope is connected to the handle support device, when the user lifts the fire extinguisher, a force of the weight moving downwards below the fire extinguisher may be used to be applied to the handle support device.

Figure 2A:
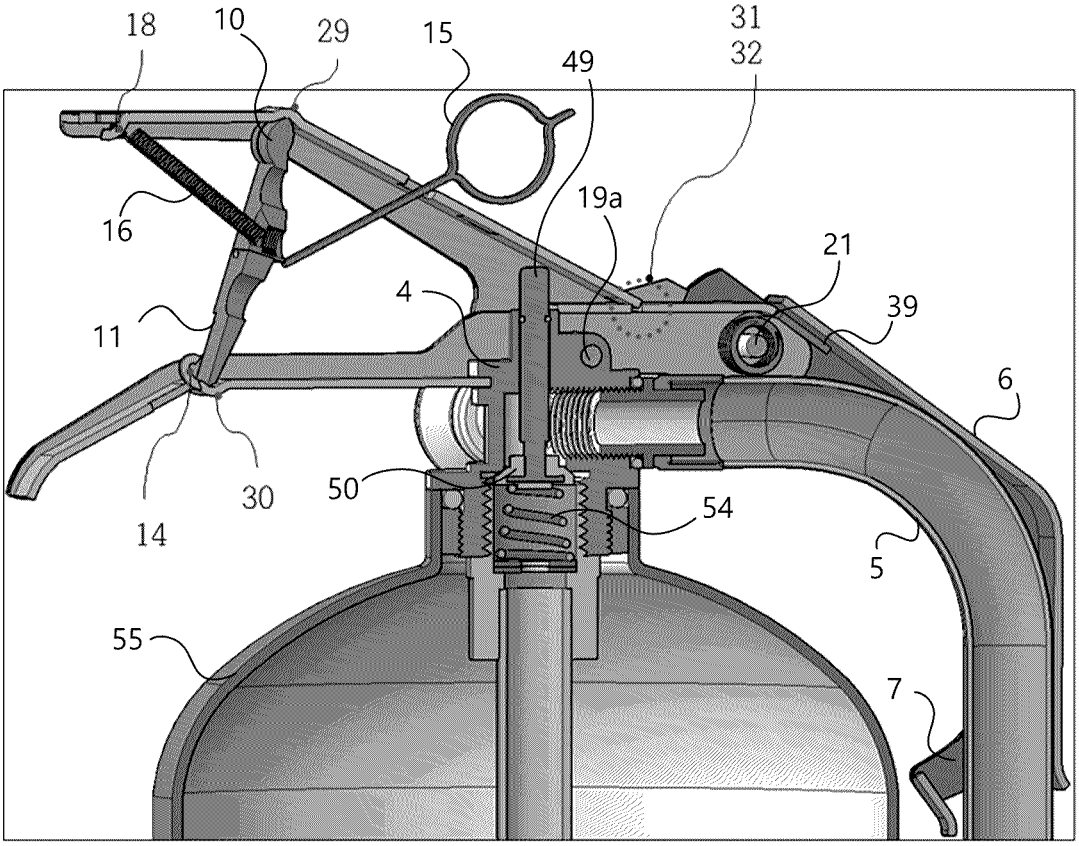
FIG. 2A is a partial cut-away view and FIG. 2B is a partial cross-sectional view illustrating the automatic fire extinguisher in FIG. 1.
Figure 2B:
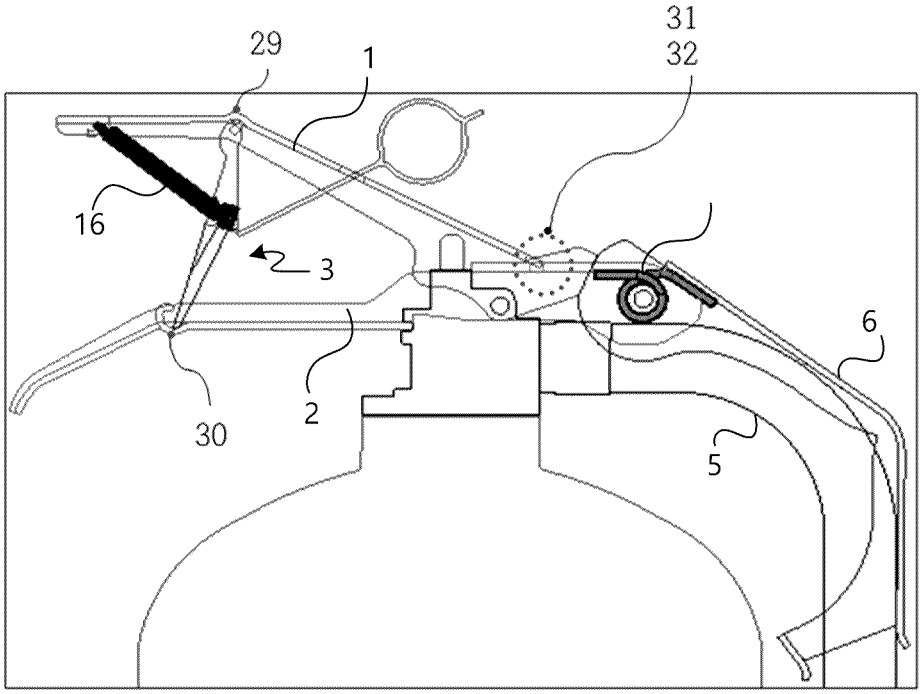
Figure 3:
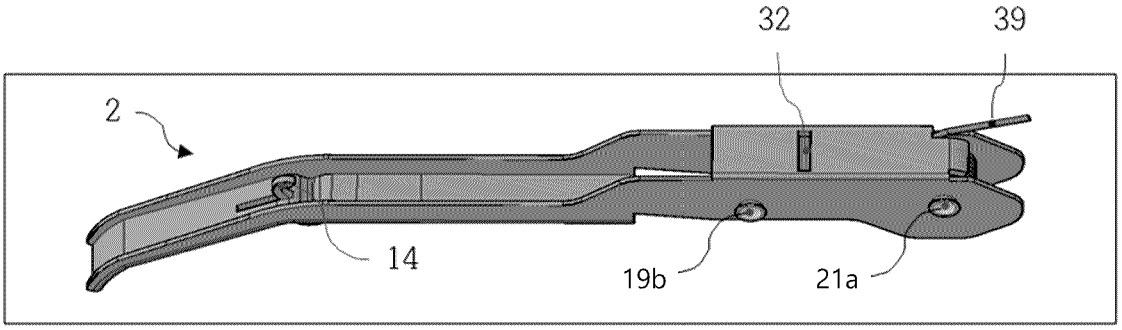
FIG. 3 is a perspective view illustrating a lower handle in FIG. 1.
Figure 4:
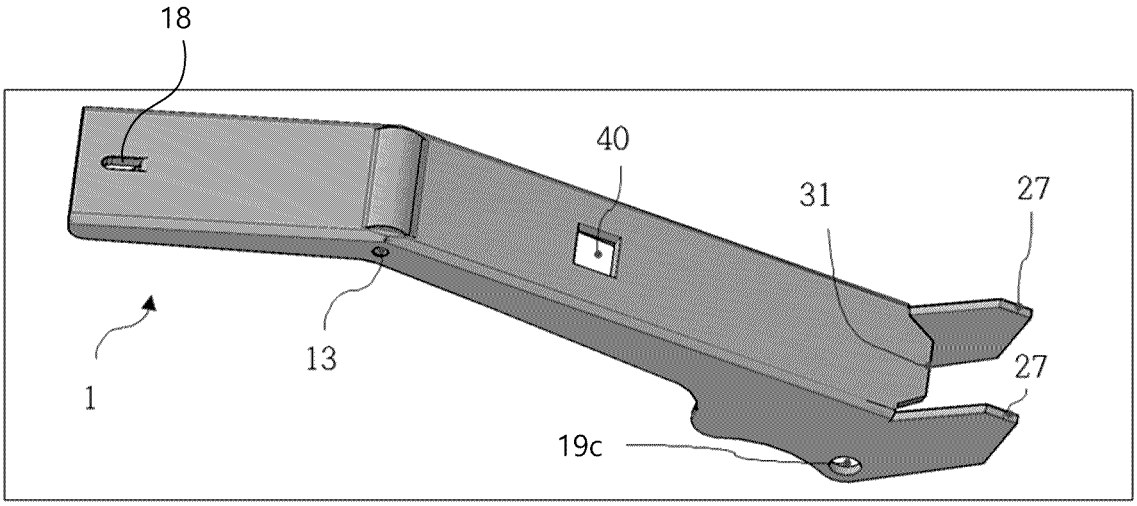
FIG. 4 is a perspective view illustrating an upper handle in FIG. 1.
Figure 5:
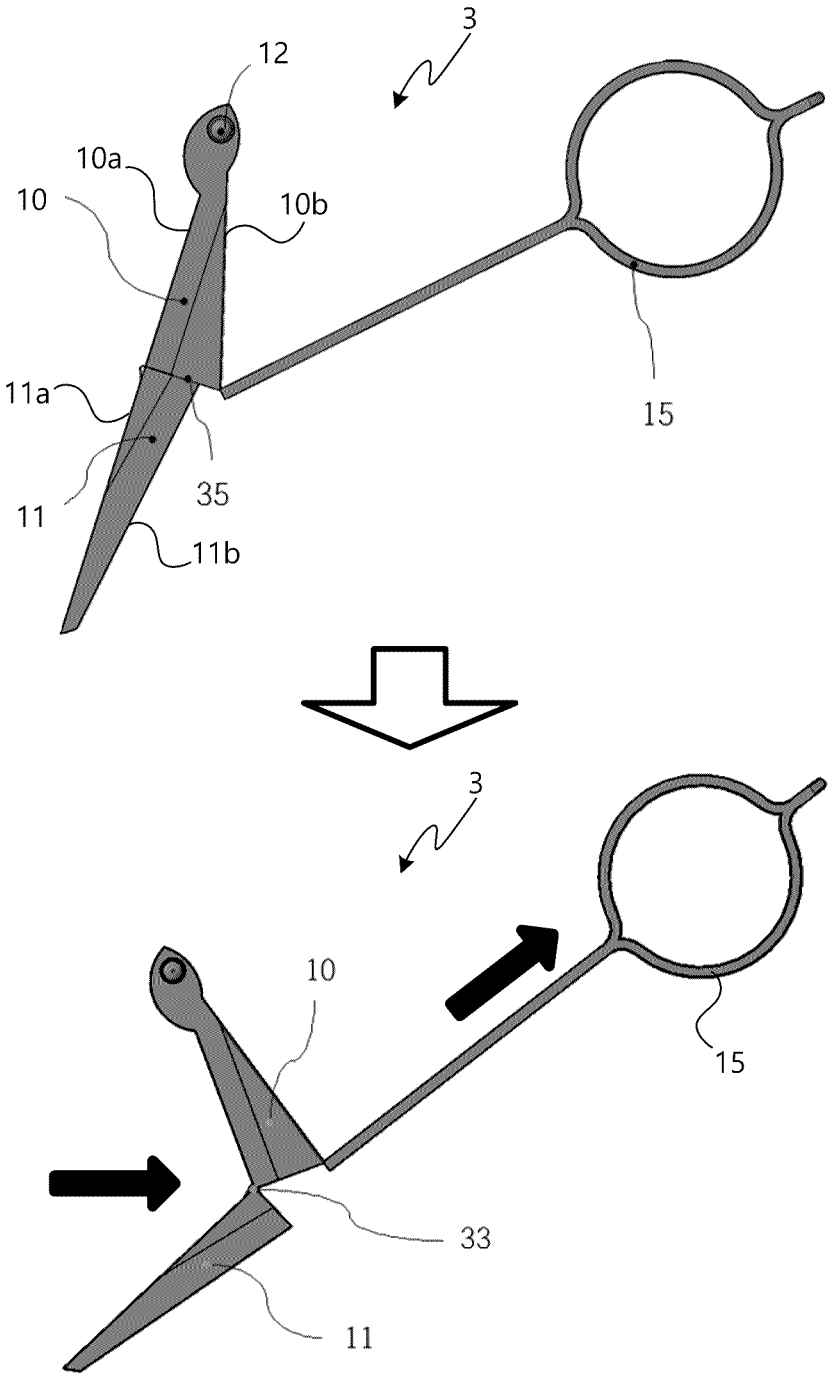
FIG. 5 is front views illustrating a handle support device in FIG. 1.
Figure 6:
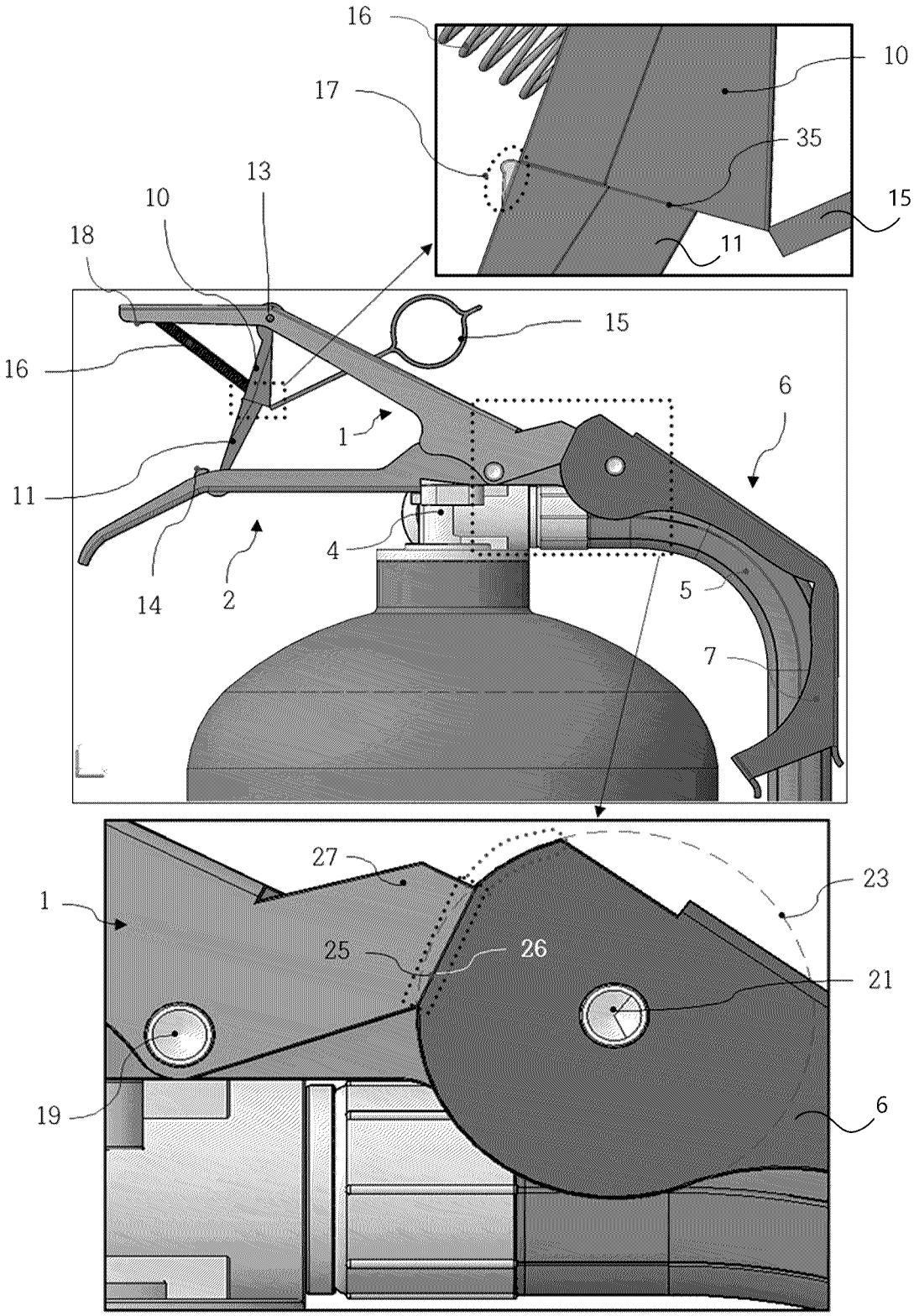
FIG. 6 is a partially enlarged front view illustrating the automatic fire extinguisher in FIG. 1.

Hereinafter, an automatic fire extinguisher according to a first embodiment of the present invention will be described with reference to FIGS. 1 to 6. Here, FIG. 1 is a perspective view and a partially enlarged perspective view illustrating the automatic fire extinguisher according to the first embodiment of the present invention. FIG. 2A is a partial cut-away view and FIG. 2B is a partial cross-sectional view illustrating the automatic fire extinguisher in FIG. 1. FIG. 3 is a perspective view illustrating a lower handle in FIG. 1. FIG. 4 is a perspective view illustrating an upper handle in FIG. 1. FIG. 5 is front views illustrating a handle support device in FIG. 1. FIG. 6 is a partially enlarged front view illustrating the automatic fire extinguisher in FIG. 1.

Firstly, referring to FIGS. 1 to 5, an automatic fire extinguisher A includes: a main body vessel 55 in which a fire extinguishing agent is filled; a lower handle 2 coupled to a plug disposed on an upper portion of the main body vessel 55; a spray hose 5 connected to the plug 4, an upper handle 1 coupled to the lower handle 2 through a first hinge shaft 19; a handle support device 3 disposed between the lower handle 2 and the upper handle 1; and a guide device 6 controlling movement of the spray hose 5.

Referring to FIGS. 2A and 2B, the plug 4 is screw-coupled to the upper portion of the main body vessel 55. A valve stem 49 is disposed in the plug 4, and a valve rubber 50 is installed on a lower end of the valve stem 49. As a valve spring 54 disposed below the valve rubber 50 applies a force to the valve rubber 50 and the valve stem 49 in an upward direction, sealing between the valve rubber 50 and the plug 5 is maintained. When the upper handle 1 pushes the valve stem 49 downwards in case of fire, the filled fire extinguishing agent is discharged through a gap between the valve rubber 50 and the plug 4 and then sprayed through the spray hose 5.

Referring to FIG. 3, the lower handle 2 includes an overall long plate and sidewalls extending from one end of the plate in a longitudinal direction. The lower handle 2 includes a support catching part 14 for fixing a lower end of a lower support 11 of the handle support device 3. The plate of the lower handle 2 may have a structure bent at a predetermined angle to enhance grip sensitivity of a user in a grip area. For example, the plate of the lower handle 2 may be bent downwards from a position 30 (refer to FIGS. 2A and 2B) at which the support catching part 14 is defined. A first hole 19*b* into which the first hinge shaft 19 is inserted and a second hole 21*a* into which a second hinge shaft 21 is inserted are defined in the sidewall of the lower handle 2. In particular, as the first hinge shaft 19 couples the first hole 19*b* of the lower handle 2, a hole 19*c* of the upper handle 1, and the hole 19*a* of the plug 4 to each other while passing therethrough, the first hinge shaft 19 serves to fix the lower handle 2 and the upper handle 1 to the plug 4. A groove 32 defined in a sub-plate connecting the sidewalls of the lower handle 2 to each other is coupled in correspondence to an insertion part 31 of the upper handle 1 and serves to restrain upward movement of the upper handle 1. A rotary spring 39 disposed around the second hole 21*a* of the lower handle 2 applies a force for vertically lifting the guide device 6, which will be described in detail later.

Referring to FIG. 4, the upper handle 1 includes an overall long plate and sidewalls disposed on one end of the plate. The upper handle 1 includes an insertion part 13 for fixing an upper end of an upper support 10 of the handle support device 3. The plate of the upper handle 1 may have a structure bent at a predetermined angle to firmly fix the upper support 10. For example, the plate of the upper handle 1 may be bent downwards from a position 29 (refer to FIGS. 2A and 2B) at which the insertion part 13 is defined. A mounting part 18 to which an elastic member 16 is fixed is defined at one side of the plate of the upper handle 1. In the exemplary embodiment, a coil spring is described as an example of the elastic member 16. A safety pin 15 is inserted through an opening 40 defined in the plate of the upper handle 1, and the opening 40 is disposed opposite to the mounting part 18 with respect to the insertion part 13. The insertion part 31 is provided on the other side of the plate of the upper handle 1. Also, the hole 19*c* into which the first hinge shaft 19 is inserted is defined in the sidewall of the upper handle 1. The sidewall of the upper handle 1 includes a protruding part 27 that is disposed opposite to the grip area with respect to the first hinge shaft 19 or the hole 19*c*.

Referring to FIG. 5, the handle support device 3 includes an upper support 10 supporting the upper handle 1, a lower support 11 supporting the lower handle 2, and a safety pin 15 connected to the upper handle 1.

Specifically, the upper support 10 has an overall cross-section of a right triangle, and a rotary projection 12 disposed on an upper end of the upper support 10 is coupled to the insertion part 13 of the upper handle 1. The upper support 10 and the lower support 11 surface-contact each other through a contact surface and are coupled to each other through a coupling part 33 disposed on one end of the contact surface 35. A surface connected to the coupling part 33 among side surfaces constituting the upper support 10, i.e., an upper vertical surface 10*a*, may be substantially perpendicular to the contact surface 35. The safety pin 15 is connected to another side surface of the upper support 10, which is opposite to the upper vertical surface 10*a*, i.e., an upper inclined surface 10*b*, and, when the user pulls the safety pin 15, the surface contact between the upper support 10 and the lower support 11 is easily released.

The lower support 11 has an overall cross-section of an inverted right triangle, and a lower end of the lower support 11 is coupled to the support catching part 14 of the lower handle 2. A surface connected to the coupling part 33 among side surfaces constituting the lower support 11, i.e., a lower vertical surface 11*a*, may be substantially perpendicular to the contact surface 35.

As described above, when each of the upper vertical surface 10*a* and the lower vertical surface 11*a* is substantially perpendicular to the contact surface 35, although the user grasps the upper handle 1 and the lower handle 2 with a strong grasping force, the handle support device 3 is not bent to maintain an original shape. Furthermore, like the exemplary embodiment, when the elastic member 16 is connected between the upper handle 1 and the upper support 10, particularly between the upper handle and the upper vertical surface 10*a*, the surface-contact state between the upper support 10 and the lower support 11 is hardly released by using only the grasping force of the user. However, even in this case, when the user pulls the safety pin 15 with a weak force, the upper support 10 and the lower support 11 are easily bent while rotating around the coupling part 33, so that the surface-contact therebetween is released. Although the flat contact surface 35 is described as an example in the exemplary embodiment, the exemplary embodiment is not limited thereto. For example, various recesses and protrusions may be defined on the contact surface 35.

The upper vertical surface 10*a* and the lower vertical surface 11*a* are desirably disposed on the same plane. To this end, when the contact surface 35 is substantially perpendicular to the upper vertical surface 10*a* or the lower vertical surface 11*a*, the two vertical surfaces are disposed on the same plane. Although the contact surface 35 is not perpendicular to the upper vertical surface 10*a* or the lower vertical surface 11*a* depending on cases, the upper vertical surface 10*a* and the lower vertical surface 11*a* may be disposed on the same plane. That is, when a sum of an angle (X) between the contact surface 35 and the upper vertical surface 10*a* and an angel (Y) between the contact surface 35 and the lower vertical surface 11*a* is substantially about 180°, the substantially same performance and effects as those of the exemplary embodiment may be achieved. In this case, when recesses and protrusions that are engaged with each other are defined on the contact surfaces 35 of the upper support 10 and the lower support 11, a coupling state between the upper support 10 and the lower support 11 may be further firmly maintained.

Referring to FIG. 6, a separating projection 17 may be provided on the lower vertical surface 11*a* adjacent to the coupling part 33 between the upper support 10 and the lower support 11. When the user grasps the upper handle 1 and the lower handle 2 with a stronger force to use the automatic fire extinguisher, the upper vertical surface 10*a* and the lower vertical surface 11*a* substantially contact each other, and, at this time, the separating projection 17 serves as a shaft of a lever, so that the upper support 10 and the lower support 11 are separated from each other. Accordingly, the automatic fire extinguisher that is used once may be prevented from being illegally reused by people without permission. Although the separating projection 17 is provided on the lower vertical surface 11*a* adjacent to the coupling part 33 as an example in the exemplary embodiment, the exemplary embodiment is not limited thereto. For example, although the separating projection is provided on the upper vertical surface 10*a* adjacent to the coupling part 33, the substantially same performance and effects as those of the exemplary embodiment may be achieved.

Also, the guide device 6 has an overall gentle V shape and surrounds at least a portion of the spray hose 5. The guide device 6 has one side coupled to the lower handle 2 through the second hinge shaft 21, specifically the second groove 21*a* of the lower handle 2, and the other side bent downwards to surround the spray hose 5. A hose catching part 7 for fixing a position of the spray hose 5 is provided on an end of the other side. When a hole into which the second hinge shaft 21 is inserted is further defined in the plug 4 in addition to the hole 19*a* into which the first hinge shaft 19 is inserted depending on cases, the guide device 6 and the plug 4 may be coupled to each other by the second hinge shaft 21. Also, the guide device 6 may not separately include the hose catching part 7.

Although the guide device 6 fundamentally receives a horizontally lifting force by the rotary spring 39 (refer to FIGS. 2A and 2B) disposed around the second hinge shaft 21, such a movement caused by the force is controlled by the upper handle. When surroundings of the second hinge shaft 21 in the guide device 6 is precisely checked, in a non-usage state of the automatic fire extinguisher A, i.e., in a state in which the upper support 10 and the lower support maintains surface-contact, contact end parts 25 and 26 between the protruding part 27 of the upper handle 1 and the guide device 6 are linearly disposed on the front view. As described above, since the protruding part 27 and the guide device 6 closely contact each other through the linear contact end parts 25 and 26, the guide device 6 maintains the spray hose 5 to face downwards. Here, both ends of the contact end parts 25 and 26 are desirable disposed on a circumference 23 with respect to the second hinge shaft 21 to exactly control the movement of the guide device 6 by only the upper handle 1 using the closely contact force at the contact end parts 25 and 26. Also, the contact end part 26 of the guide device 6 desirably has at least one portion from an upper end of the linear part to an upper portion, which is disposed on a concentric circle 23 to continuously maintain a state in which the safety device is released.

Figure 7:
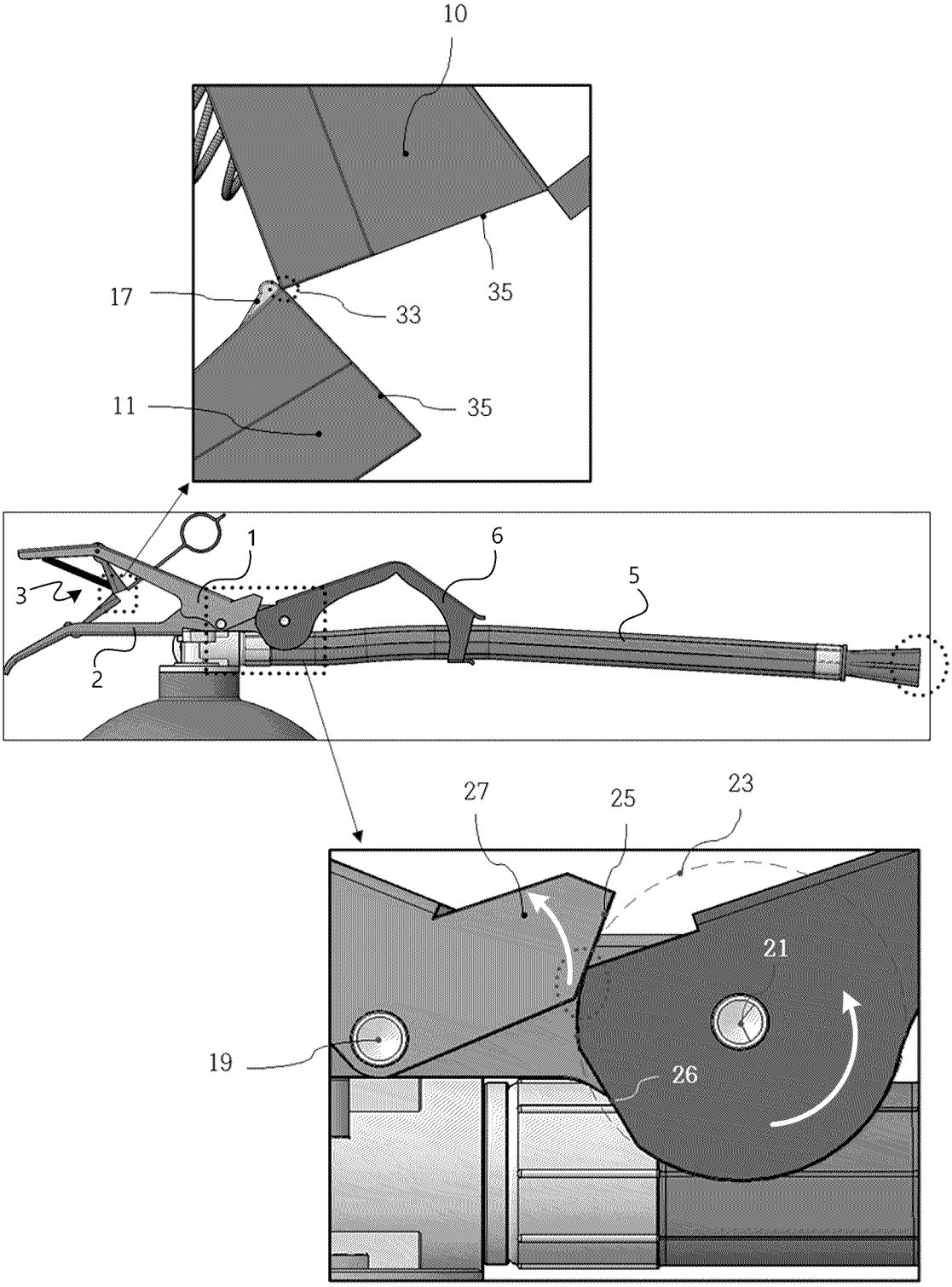
FIG. 7 is a view for sequentially explaining an operation method of the automatic fire extinguisher in FIG. 1.

Hereinafter, an operation method of the automatic fire extinguisher according to the first embodiment of the present invention will be described with reference to FIGS. 7 to 9. Here, FIGS. 7, 8A and 8B are views for sequentially explaining the operation method of the automatic fire extinguisher in FIG. 1. FIGS. 9A and 9B are views illustrating a method for returning the automatic fire extinguisher to an initial state.

Referring to FIG. 7, in a state in which the surface contact between the upper support 10 and the lower support 11 is maintained, a rotating force caused by the rotary spring 39 allows the upper handle 1 to push the lower handle 2 downwards through the contact end parts 25 and 26, and thus, when the user pulls the safety pin 15, the upper support 10 and the lower support 11 are bent while rotating around the coupling part 33. Here, the protruding part 27 of the upper handle 1 ascends with respect to the first hinge shaft 19, and accordingly, the contact end part 25 of the protruding part 27 and the contact end part 26 of the guide device 6 are dislocated from each other. Accordingly, as the force controlling the movement of the guide device 6 is disappeared, the guide device 6 rotates in a counter clockwise direction by the rotating force of the rotary spring 39. Resultantly, the spray hose 5 is stretched out in a horizontal direction through only an operation of pulling the safety pin 15. Although the rotary spring 39 is not provided depending on cases, a restoration force of the spray hose 5 having elasticity may be used.

Figure 8A:
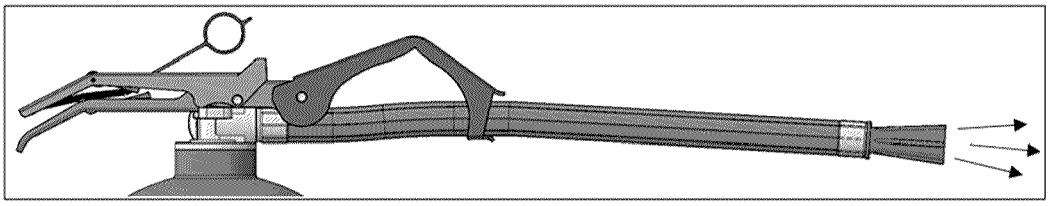
FIGS. 8A and 8B are views for sequentially explaining an operation method of the automatic fire extinguisher in FIG. 1.
Figure 8B:
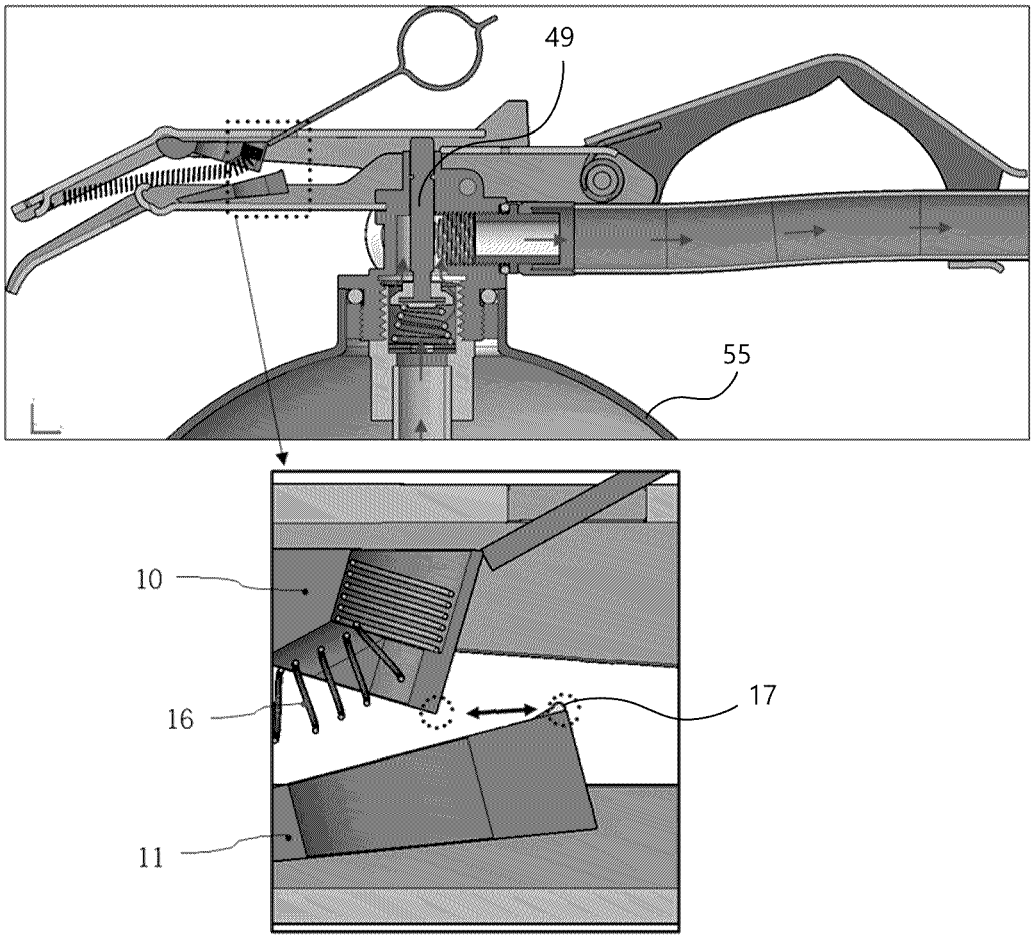
Figure 9A:
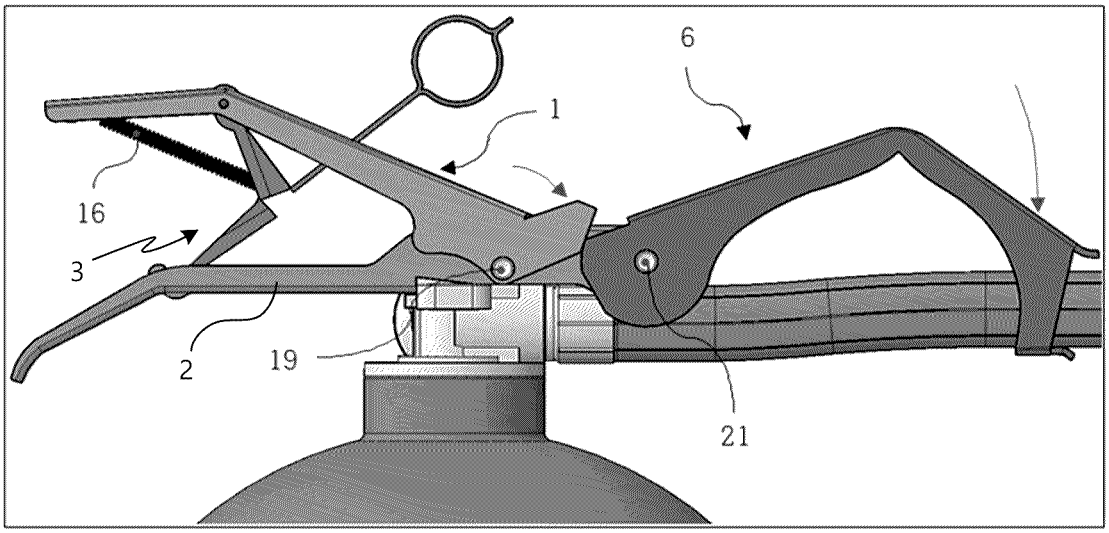
FIGS. 9A and 9B are views illustrating a method for returning the automatic fire extinguisher in FIG. 1 to an initial state.
Figure 9B:
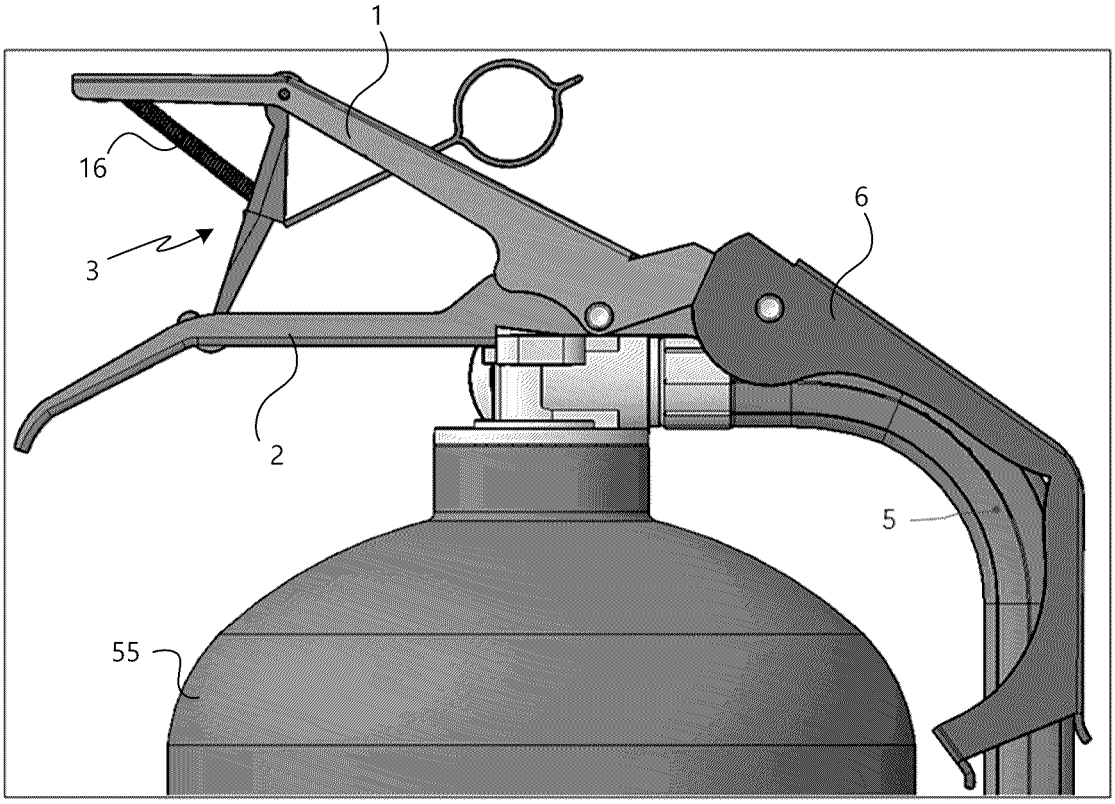

Thereafter, referring to FIGS. 8A and 8B, when the user pushes the upper handle 1 more harder so that the upper handle 1 and the lower handle 2 substantially contact each other, the separating projection 17 serves as a shaft of a lever, so that the upper handle 1 and the lower handle 2 are separated from each other. At the same time, as the upper handle 1 pushes downwards the valve stem 49, the fire extinguishing agent filled in the main body vessel 55 is sprayed through the spray hose 5.

Referring to FIGS. 9A and 9B, when the user rotates downwards the guide device 6 with respect to the second hinge shaft 21 to return the guide device 6 to an initial state after usage of the automatic fire extinguisher, the contact end part 26 of the guide device 6 and the contact end part 25 of the upper handle 1 are aligned to contact each other, and the upper handle 1 automatically moves upwards. Accordingly, the handle support device 3 returns to the initial state, i.e., a state in which the upper support 10 and the lower support 11 surface-contact each other by a single operation.

Figure 10:
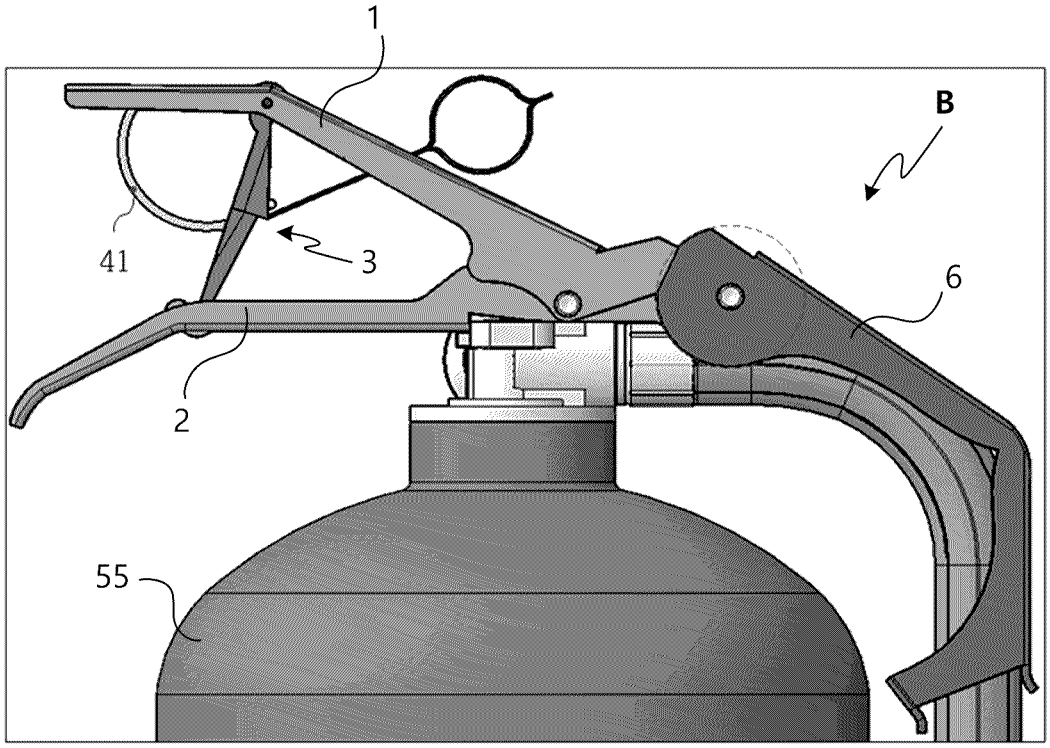
FIG. 10 is a front view illustrating an automatic fire extinguisher according to a second embodiment of the present invention.
Figure 11:
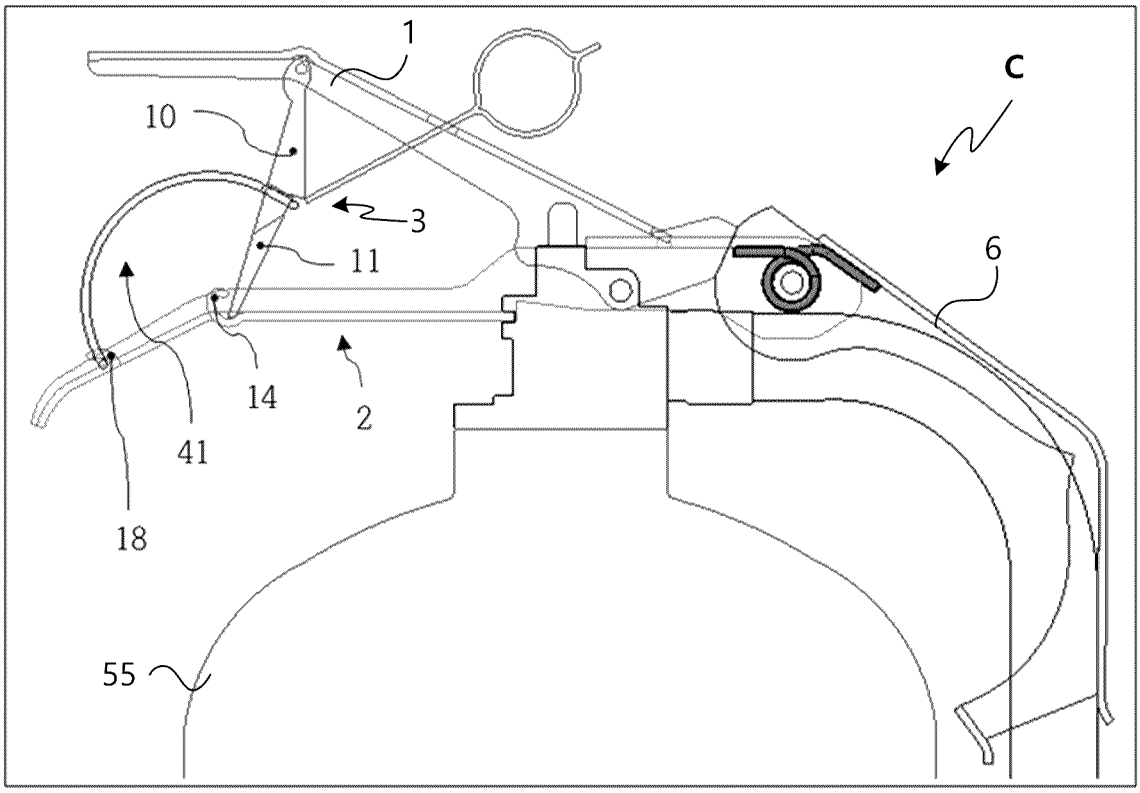
FIG. 11 is a view illustrating a modified example of the automatic fire extinguisher in FIG. 10.

Hereinafter, an automatic fire extinguisher according to a second embodiment of the present invention will be described with reference to FIGS. 10 to 11. Here, FIG. 10 is a front view illustrating the automatic fire extinguisher according to the second embodiment of the present invention. FIG. 11 is a view illustrating a modified example of the automatic fire extinguisher in FIG. 10. Different points from the first embodiment (refer to FIGS. 1 to 9) will be mainly described for convenience of description.

As illustrated in FIG. 10, an automatic fire extinguisher B according to the embodiment uses U-shaped plate spring as an elastic member 41 for connecting the handle support device 3 to the upper handle 1.

Referring to FIG. 11, an elastic member 41 that is a U-shaped plate spring used in an automatic fire extinguisher C of the modified example connects the lower handle 2 to the handle support device 3.

Figure 12:
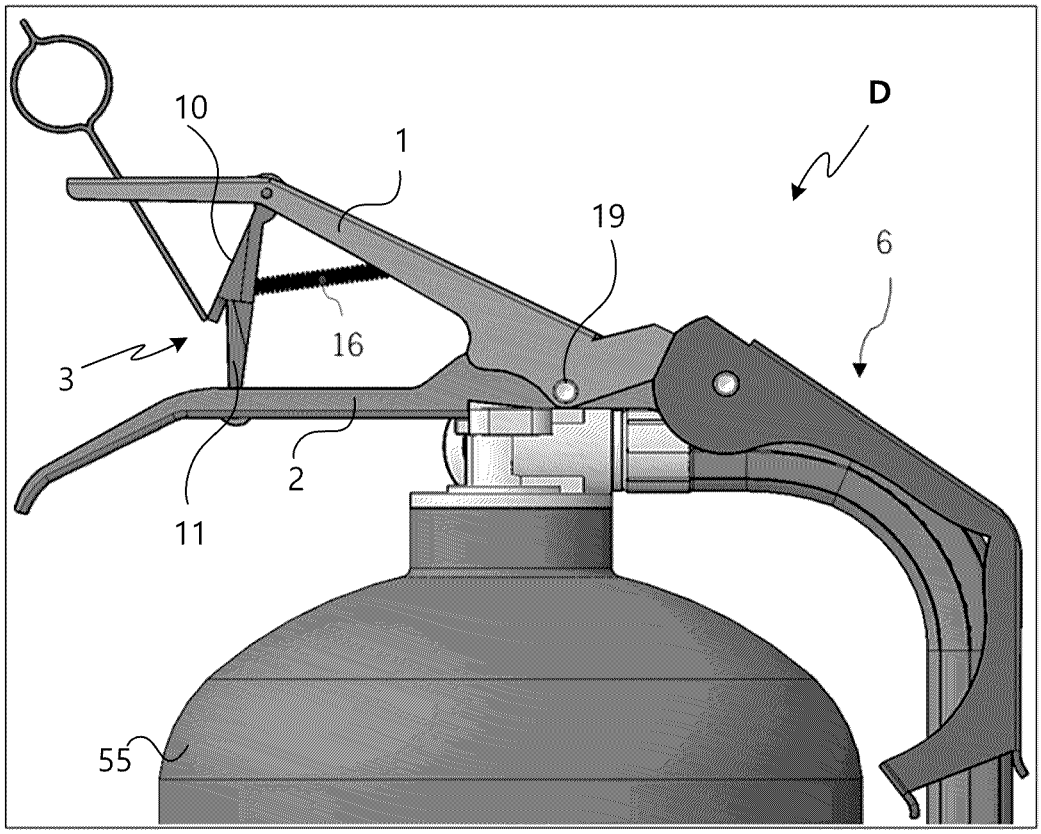
FIG. 12 is a front view illustrating an automatic fire extinguisher according to a third embodiment of the present invention.

Hereinafter, an automatic fire extinguisher according to a third embodiment will be described with reference to FIG. 12. Here, FIG. 12 is a front view illustrating the automatic fire extinguisher according to the third embodiment of the present invention. Different points from the first embodiment (refer to FIGS. 1 to 9) will be mainly described for convenience of description.

As illustrated in FIG. 12, in an automatic fire extinguisher D according to the embodiment, positions of the safety pin 15 and the elastic member 16 are exchanged. That is, the elastic member 16 is installed in a direction toward the first hinge shaft 19 with respect to the upper support 10 and the lower support 11, and the safety pin 15 is installed in a direction opposite thereto.

Figure 13:
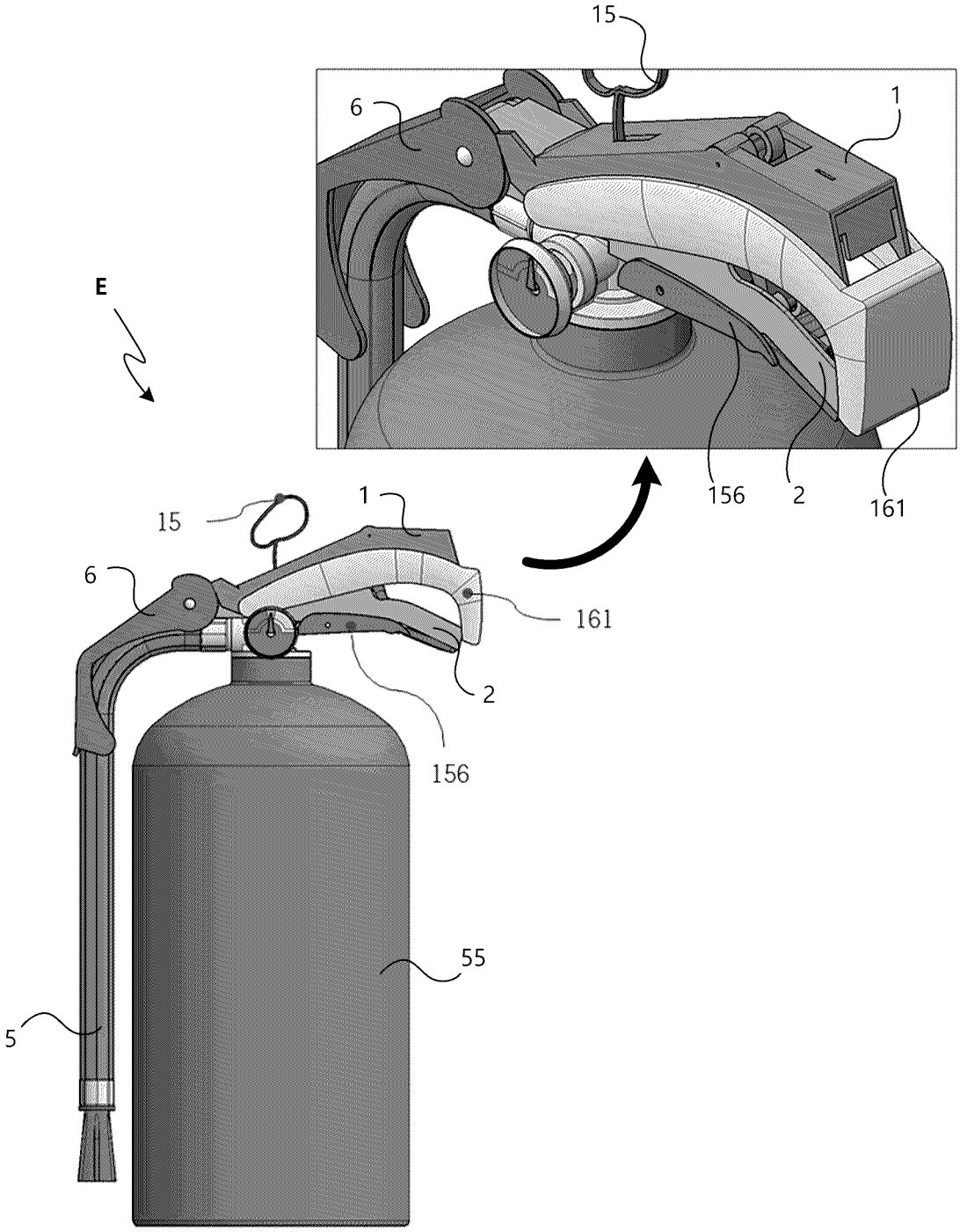
FIG. 13 is a front view and a partially enlarged perspective view illustrating an automatic fire extinguisher according to a fourth embodiment of the present invention.
Figure 14:
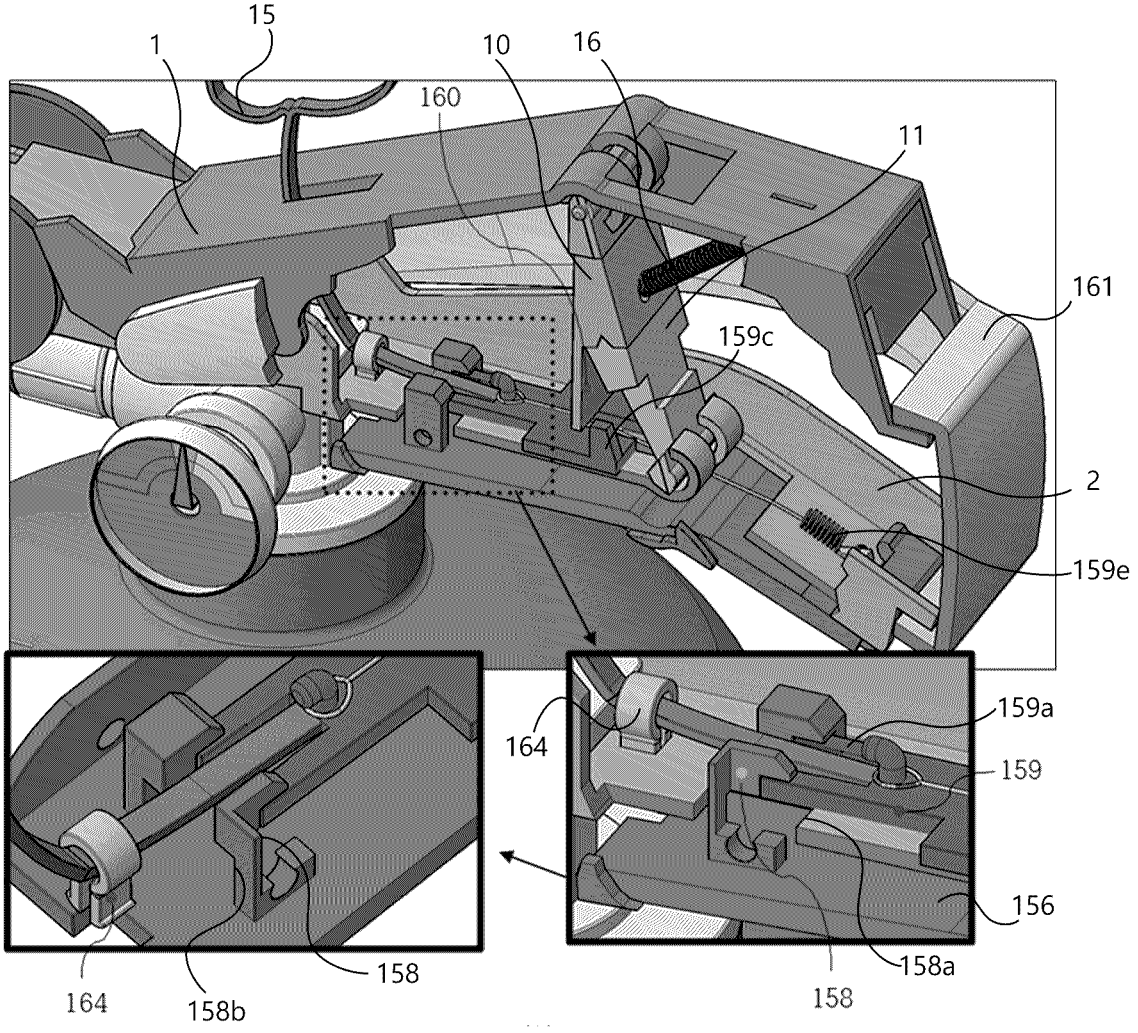
FIG. 14 is a partial cut-away view illustrating the automatic fire extinguisher in FIG. 13.
Figure 15:
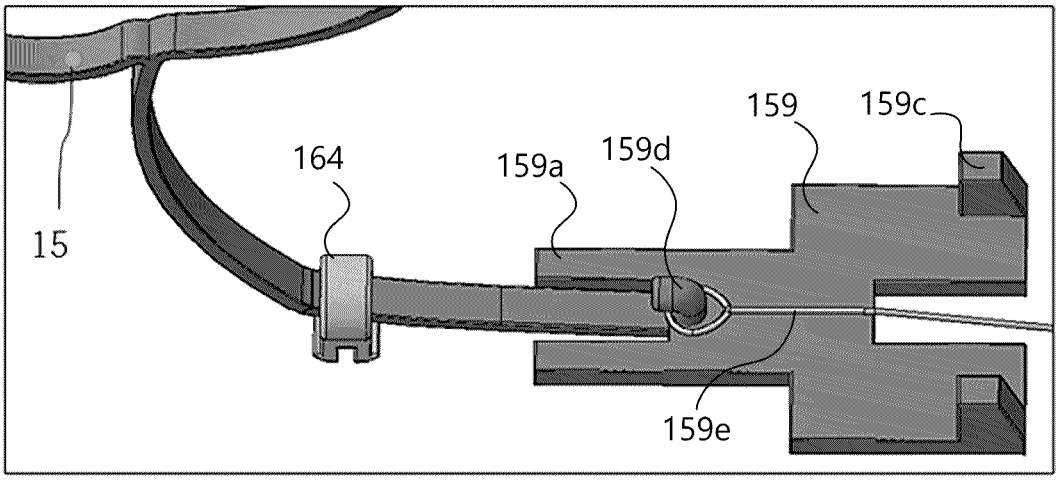
FIG. 15 is a perspective view illustrating a safety pin and a slider in FIG. 13.
Figure 16:
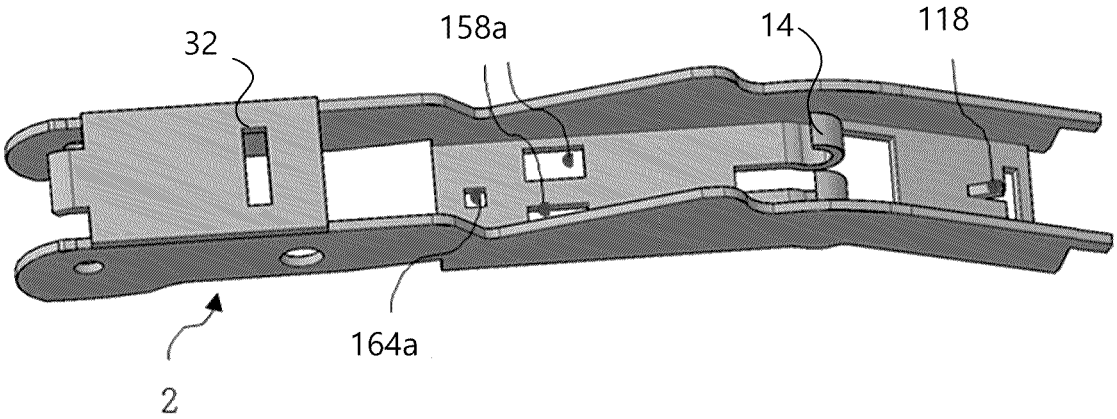
FIG. 16 is a perspective view illustrating a lower handle in FIG. 13.
Figure 17:
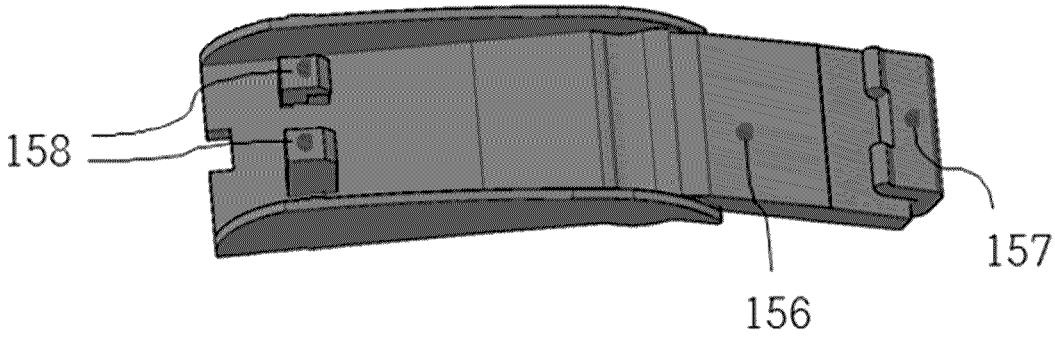
FIG. 17 is a perspective view illustrating a safety handle in FIG. 13.

Hereinafter, an automatic fire extinguisher according to a fourth embodiment of the present invention will be described with reference to FIGS. 13 to 17. Here, FIG. 13 is a front view and a partially enlarged perspective view illustrating the automatic fire extinguisher according to the fourth embodiment of the present invention. FIG. 14 is a partial cut-away view illustrating the automatic fire extinguisher in FIG. 13. FIG. 15 is a perspective view illustrating a safety pin and a slider in FIG. 13. FIG. 16 is a perspective view illustrating a lower handle in FIG. 13. FIG. 17 is a perspective view illustrating a safety handle in FIG. 13. Different points from the first embodiment (refer to FIGS. 1 to 9) will be mainly described for convenience of description.

Referring to FIGS. 13 and 14, an automatic fire extinguisher E according to the embodiment further includes a protection cover 161 covering at least a portion of side portions of the upper handle 1 and the lower handle 2. Here, the protection cover 161 has an overall U-shape and is rotatable around the first hinge shaft 19. Also, the protection cover 161 is disposed on a portion in which the upper handle 1 and the lower handle 2 are coupled, i.e., disposed to cover surroundings of the first hinge shaft 19, thereby substantially serving to protect the handle support device 3. The protection cover 161 has an end in a direction opposite to the first hinge shaft 19, and the end accommodates and protects the end of the upper handle 1 and the end of the lower handle 2.

In the handle support device according to the embodiment, recesses and protrusions are provided on the contact surfaces of the upper support 10 and the lower support 11. Although the recesses and protrusions are provided on the contact surface, overall, the contact surface may be substantially perpendicular to the upper vertical surface of the upper support 10 and the lower vertical surface of the lower support 11. The upper support 10 includes another side surface opposite to the upper vertical surface, i.e., an upper support skirt extending downwards from the upper inclined surface.

Referring to FIGS. 14 and 15, although the safety pin 15 is not directly connected to the upper support 10 in the embodiment, the safety pin 15 includes a slider 159 on the end thereof to control the movement of the upper support 10. Specifically, the slider 159 is provided on a side opposite to a handle of the safety pin 15 and has an overall plate shape. The slider 159 may be seated on the lower handle 2 and linearly move along a longitudinal direction of the lower handle 2. The slider 159 and the handle of the safety pin 15 may be made of the same material to be integrated with each other.

The slider 159 includes a skirt catching part 159*c* protruding upwards to move the upper support skirt 160, a mounting part 159*d* fixing one side of a slider elastic member 159*e*, and a sliding projection 159*a* horizontally protruding toward the handle of the safety pin 15.

The skirt catching part 159*c* is normally disposed between the upper support skirt 160 and the lower support 11. To this end, the slider elastic member 159*e* is connected between the mounting part 159*d* of the slider 159 and the mounting part 118 of the lower handle 2. One end of the slider elastic member 159*e* may be mounted to a fixing part 157 of a safety handle 156 depending on cases. Although a coil spring is described as an example of the elastic member 159*e* in the embodiment, the embodiment of the present invention is not limited thereto. When the user pulls the safety pin 15 to user the fire extinguisher, as the skirt catching part 159*c* horizontally pushes the upper support skirt 160, the coupling between the upper support 10 and the lower support 11, i.e., the surface-contact, is released.

Referring to FIGS. 14 and 16, the lower handle 2 includes a guide hole 164*a* into which a safety pin guide 164 for controlling a movement direction of the safety pin 15 is inserted. The safety pin guide 164 may have a U-shape or a ring shape so that the safety pin 15 passes therethrough. Although the user pulls the safety pin 15 upwards, the slider 159 may horizontally move by virtue of the safety pin guide 164.

Referring to FIGS. 14 to 17, the automatic fire extinguisher E according to the embodiment further include a safety handle 156 disposed below the lower handle 2 to prevent the safety pin 15 from being pulled out in a situation in which the user does not want. The safety handle 156 includes a fixing part 157 and a stopper 158.

The safety handle 156 has an overall plate shape and include the fixing part 157 firmly fixed to the grip area of the lower handle 2, which is disposed on one end thereof. The safety handle 156 includes a protruding stopper 158 inserted into a stopper hole 158*a* defined in the lower handle 2, which is disposed on the other end thereof. Since the other end of the safety handle 156 is not fixed to the lower handle 2, when an upward force is not applied to the safety handle 156 at normal times, the other end of the safety handle 156 is spaced apart from the lower handle 2. Selectively, to this end, when the safety handle 156 is molded, the safety handle 156 may be curvedly formed.

Also, referring to FIG. 14, the stopper 158 has an overall structure in which an upper portion is greater in size than a lower portion because a recessed part 158*b* is defined in a lower inside wall of the stopper 158. For example, when viewed from the safety pin guide 164, the stopper 158 has a Greek capital letter gamma (F) shape, and a pair of stoppers may be disposed so that the recessed parts 158*b* face each other.

Hereinafter, an operation method of the automatic fire extinguisher according to the fourth embodiment of the present invention will be described with reference to FIGS. 18 to 20. Here, FIGS. 18 and 20 are views for sequentially explaining the operation method of the automatic fire extinguisher in FIG. 13.

Figure 18:
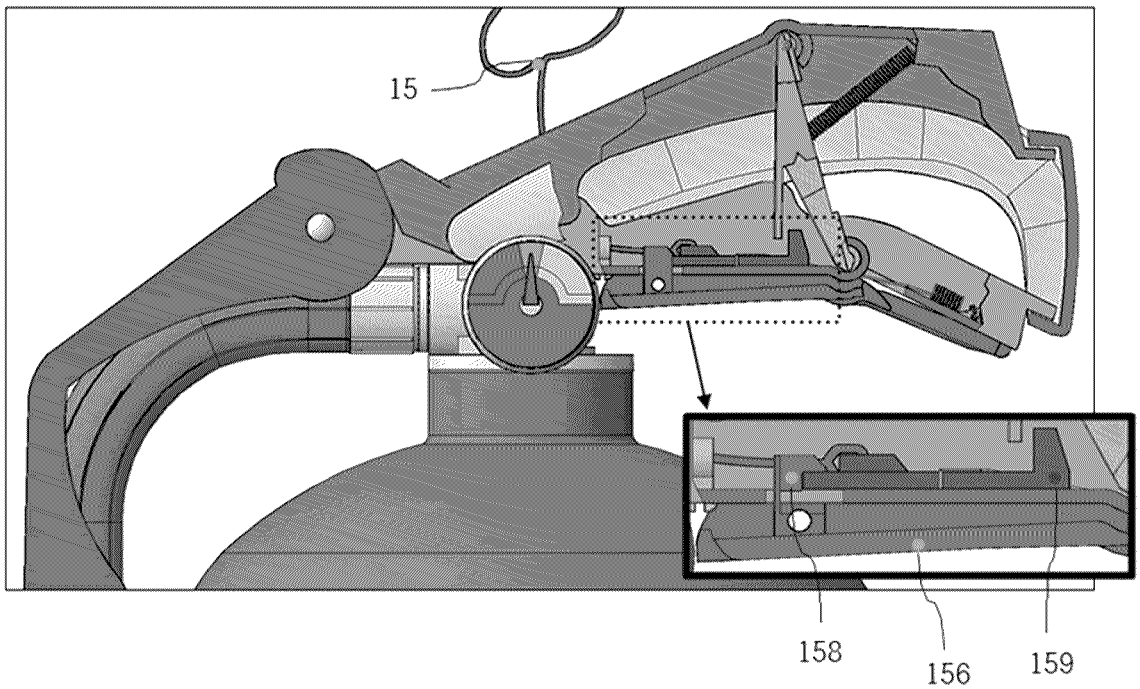
FIG. 18 is a view for sequentially explaining an operation method of the automatic fire extinguisher in FIG. 13.

Referring to FIGS. 14 and 18, firstly, in a state in which a force is not applied to the safety handle 156, i.e., at normal times, the other end of the safety handle 156 is spaced apart from the lower handle 2. Accordingly, only a partial upper portion of the stopper 158 is inserted into the stopper hole 158*a*. In the above-described state, although the user pulls the safety pin 15, since the upper portion of the stopper 158 is greater in size, the sliding projection 159*a* may be caught by the stopper 158, and thus the slider 159 may not move Accordingly, even when the user tries to pull only the safety pin 15 without pulling the safety handle 156, the safety pin 15 does not move.

Figure 19:
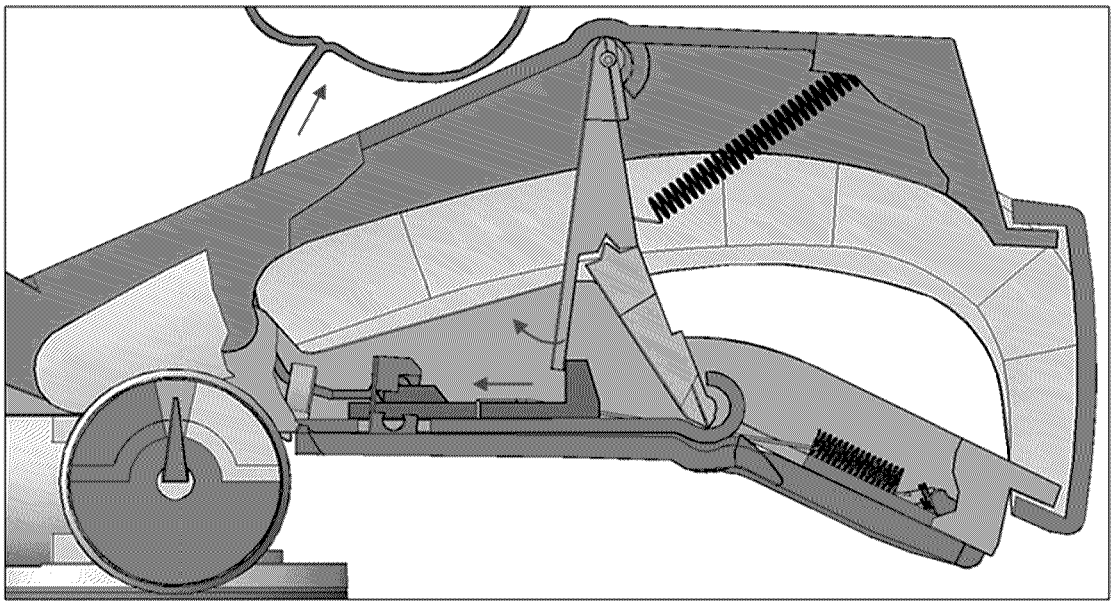
FIG. 19 is a view for sequentially explaining an operation method of the automatic fire extinguisher in FIG. 13.

Referring to FIGS. 14 and 19, the user has to grasp the safety handle 156 together with the upper handle 1 and the lower handle 2 to user the automatic fire extinguisher in case of fire occurrence. In this case, the stopper 158 of the safety handle 156 is completely inserted into the stopper hole 158*a*, and a lower end of the stopper 158, i.e., the recessed part 158*b*, is disposed at a position corresponding to the sliding projection 159*a*. Thereafter, when the user pulls the safety pin 15, the slider 159 horizontally moves while passing through the recessed part 158*b*, as the skirt catching part 159*c* horizontally move the upper support skirt 160, the coupling between the upper support 10 and the lower support 11 is broken, and as the guide device 5 automatically rotates, the spray hose 5 is horizontally stretched.

Figure 20:
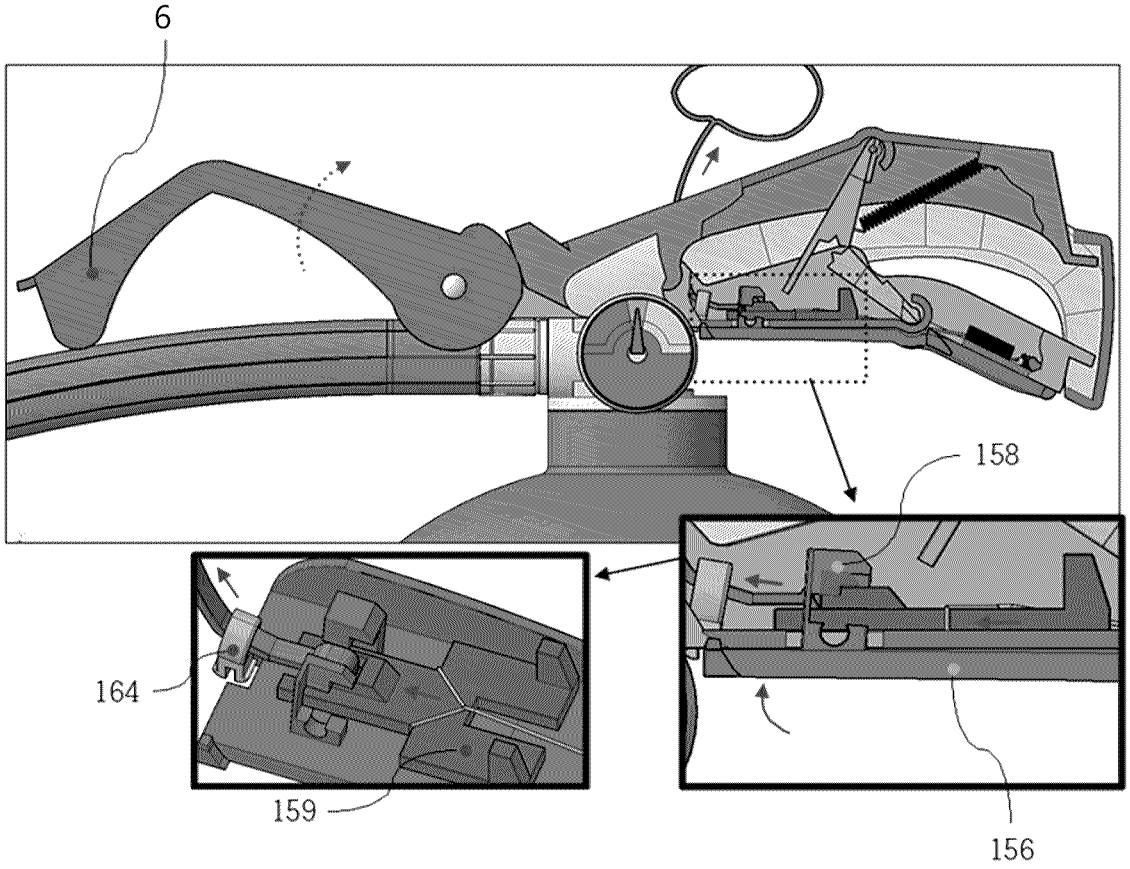
FIG. 20 is a view for sequentially explaining an operation method of the automatic fire extinguisher in FIG. 13.

Referring to FIGS. 14 and 20, when the user further strongly grasps the upper handle 1, the lower handle 2, and the safety handle 156, the upper handle 1 pushes the valve stem 49, and thus the fire extinguishing agent is sprayed.

Figure 21:
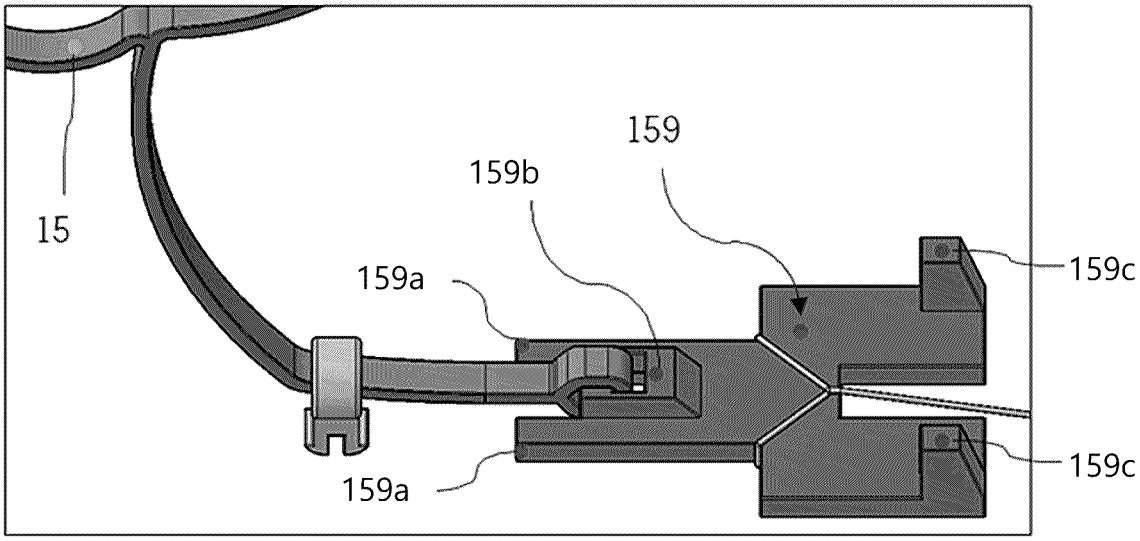
FIG. 21 is a modified example of FIG. 15.

FIG. 21, which is a modified example of FIG. 15, illustrates a state in which the handle and the slider 159 of the safety pin 15 are separately manufactured when the safety pin is manufactured and then coupled through a coupling part 159*b*.

Figure 22:
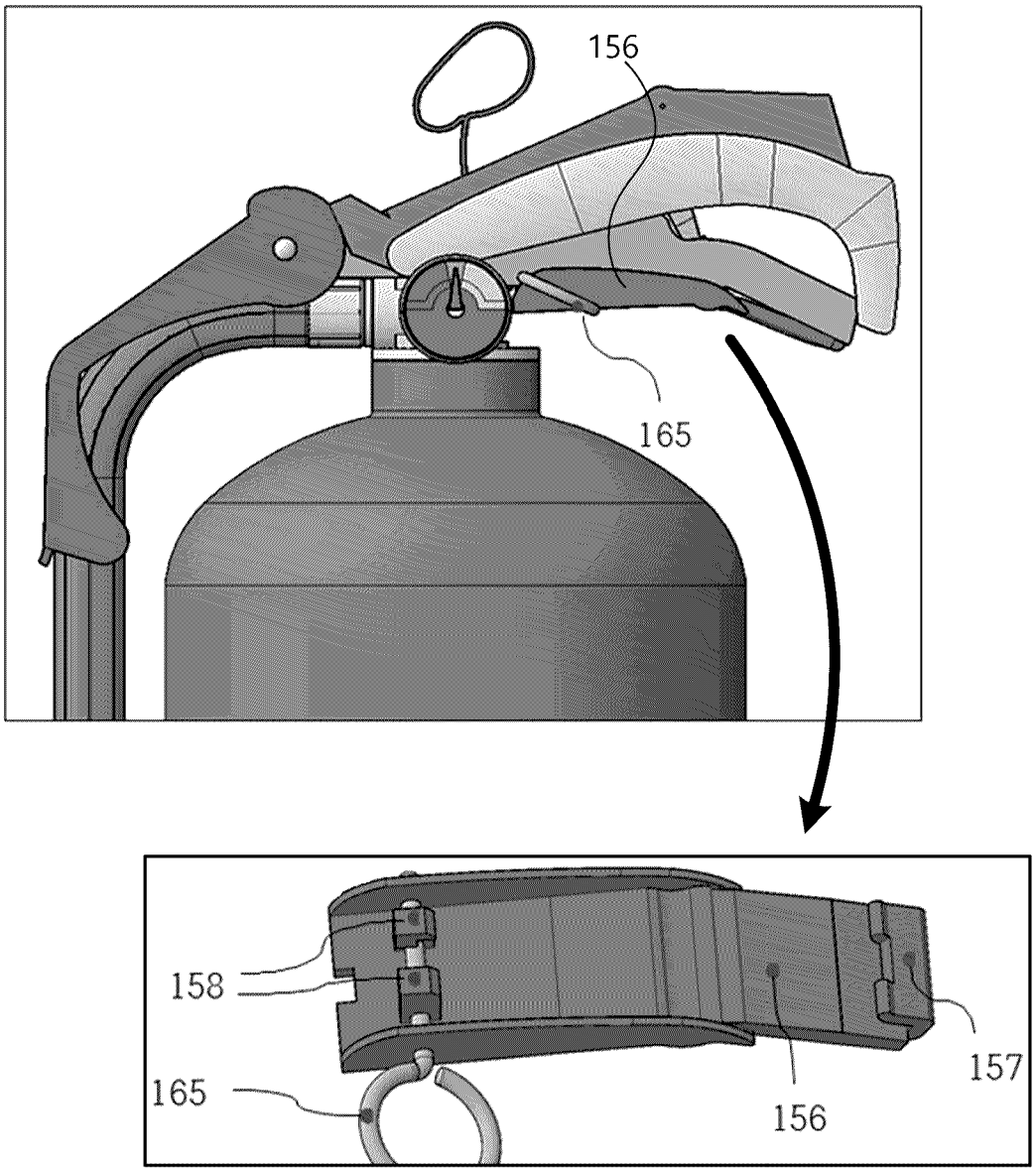
FIG. 22 is a front view illustrating an automatic fire extinguisher and a perspective view of a safety handle according to a fifth embodiment of the present invention.

Hereinafter, an automatic fire extinguisher according to a fifth embodiment will be described with reference to FIG. 22. Here, FIG. 22 is a front view and a perspective view illustrating the automatic fire extinguisher according to the fifth embodiment of the present invention. Different points from the fourth embodiment (refer to FIGS. 13 to 21) will be mainly described for convenience of description.

In the embodiment, a safety pin for distribution 165 (hereinafter, referred to as a distribution safety pin) inserted while passing through a side portion of the safety handle 156 or the stopper 158 is further provided. When the distribution safety pin 165 passes through the side portion of the safety handle 156, since the distribution safety pin 165 is inserted between the safety handle 156 and the lower handle 2, although the user grasps the safety handle 156 by hands, the stopper 158 is not sufficiently lifted. For another example, when the distribution safety pin 165 is inserted into the stopper 158, the slider 159, specifically the sliding projection 159*a*, is prevented from horizontally moving to fundamentally prevent the safety pin 15 from being undesirably pulled out in a process of distributing the automatic fire extinguisher. When the automatic fire extinguisher is arranged at a site through the distribution process, the distribution safety pin 165 may be removed.

The description of the present invention is intended to be illustrative, and those with ordinary skill in the technical field of the present invention will be understood that the present invention can be carried out in other specific forms without changing the technical idea or essential features. Therefore, the above-disclosed embodiments are to be considered illustrative and not restrictive.

The invention claimed is:

1. An automatic fire extinguisher comprising:

a main body vessel configured to contain a fire extinguishing agent;

a plug disposed on an upper portion of the main body vessel and having a valve configured to discharge the fire extinguishing agent contained in the main body vessel;

a lower handle coupled to the plug;

an upper handle coupled with the lower handle through a first hinge shaft;

a handle supporter disposed between the lower handle and the upper handle, wherein the handle supporter comprises:

an upper supporter connected to the upper handle at a first end of the upper supporter;

a lower supporter connected to the lower handle at a first end of the lower supporter and coupled with the upper supporter by surface-contacting a second end of the upper supporter and a second end of the lower supporter to each other;

a coupling member disposed on the second end of the upper supporter and the second end of the lower supporter to surface-contact the upper supporter and the lower supporter to each other; and a tool connected to the handle supporter to release coupling of the handle supporter; and an elastic member disposed between the upper handle and the handle supporter or between the lower handle and the handle supporter, wherein, when the tool is pulled, the upper supporter and the lower supporter are bent while rotating about the coupling member so that the surface-contacting between the upper supporter and the lower supporter is released.

2. The automatic fire extinguisher of claim 1, wherein each contacting surface of the second end of the upper supporter and the second end of the lower supporter is substantially perpendicular to each upper surface of the upper supporter and the lower supporter.

3. The automatic fire extinguisher of claim 1, further comprising:

a guide member connected to the lower handle through a second hinge shaft and configured to lift up a hose connected to the plug.

4. The automatic fire extinguisher of claim 3, wherein the upper handle comprises:

a protruding portion disposed opposite to a grip area with respect to the first hinge shaft and configured to be contacted to the guide member by a contact surface of the protruding portion.

5. The automatic fire extinguisher of claim 4, wherein both ends of the contact surface of the protruding portion are disposed on a circumference having a center at the second hinge shaft.

6. The automatic fire extinguisher of claim 1, wherein both upper surfaces of the upper supporter and the lower supporter are substantially disposed on the same plane.

7. The automatic fire extinguisher of claim 1, wherein when the upper supporter and the lower supporter are bent while rotating about the coupling member, the surface-contacting between the upper supporter and the lower supporter is released.

8. The automatic fire extinguisher of claim 1, wherein the tool comprises a safety pin connected to the upper supporter, and, when the safety pin is pulled, the surface-contacting between the upper supporter and the lower supporter is released.

9. The automatic fire extinguisher of claim 1, wherein the upper supporter comprises an upper support skirt extending downwards from a lower surface opposite to the upper surface of the upper supporter, and the tool comprises a slider having a skirt catching portion protruding upwards and configured to move the upper support skirt.

10. The automatic fire extinguisher of claim 8, further comprising:

a safety handle disposed below the lower handle, wherein the safety handle comprises one end coupled to a grip area of the lower handle, and the other end comprising a protruding stopper inserted into a stopper hole formed on the lower handle.

11. The automatic fire extinguisher of claim 10, wherein the stopper comprises a recessed part formed on a lower sidewall thereof, and when the safety handle is pulled, the other end of the safety handle is configured to be contacted to the lower handle, the stopper is configured to be inserted into the stopper hole, and the slider is configured to be linearly moved through the recessed part.

12. The automatic fire extinguisher of claim 1, wherein the tool comprises a weight and a rope, and a force is applied to the handle supporter by using a force of the weight moving downwards when the automatic fire extinguisher is lifted.

* * * * *